US007506727B2

(12) United States Patent
Spiess

(10) Patent No.: US 7,506,727 B2
(45) Date of Patent: Mar. 24, 2009

(54) DOOR WITH SLIDING DOOR LEAF AND WITH GUIDE MEANS

(75) Inventor: Peter Spiess, Meggen (CH)

(73) Assignee: Inventio AG, Hergiswil NW (CH)

( * ) Notice: Subject to any disclaimer, the term of this patent is extended or adjusted under 35 U.S.C. 154(b) by 181 days.

(21) Appl. No.: 10/677,989

(22) Filed: Oct. 2, 2003

(65) Prior Publication Data

US 2004/0128913 A1 Jul. 8, 2004

(51) Int. Cl.

| | |
|---|---|
| ***B66B 13/24*** | (2006.01) |
| ***B66B 13/28*** | (2006.01) |
| ***E05F 11/00*** | (2006.01) |
| ***E05D 13/00*** | (2006.01) |
| ***E05D 15/06*** | (2006.01) |
| ***E05D 15/16*** | (2006.01) |

(52) U.S. Cl. ..... 187/340; 187/336; 187/400; 49/360; 49/409; 49/410

(58) Field of Classification Search ..... 49/120, 49/303, 304, 475.1, 489.1, 358, 360, 409, 49/410; 187/336, 340, 341, 400
See application file for complete search history.

(56) References Cited

U.S. PATENT DOCUMENTS

| | | | | |
|---|---|---|---|---|
| 1,043,492 | A * | 11/1912 | Werner et al. | 160/199 |
| 2,708,285 | A | 5/1955 | Greenspon et al. | |
| 3,255,807 | A * | 6/1966 | Steele, Jr. | 160/201 |
| 3,523,390 | A * | 8/1970 | McAulay, Jr. | 49/411 |
| 3,611,637 | A * | 10/1971 | Saino | 49/235 |
| 3,798,705 | A * | 3/1974 | Julian et al. | 16/94 R |
| 3,890,744 | A * | 6/1975 | Galis | 49/360 |
| 4,235,119 | A * | 11/1980 | Wetzel | 474/205 |
| 4,331,500 | A * | 5/1982 | Gersbeck et al. | 156/307.7 |
| 4,573,286 | A * | 3/1986 | Favrel et al. | 49/214 |
| 4,674,231 | A * | 6/1987 | Radek et al. | 49/118 |
| 4,781,270 | A | 11/1988 | Holland | |
| 4,893,435 | A * | 1/1990 | Shalit | 49/360 |
| 5,273,363 | A * | 12/1993 | Prete | 384/7 |
| 6,330,763 | B1 * | 12/2001 | Kern et al. | 49/231 |
| 6,807,775 | B2 * | 10/2004 | Hoare et al. | 49/362 |
| 6,854,212 | B2 * | 2/2005 | Engelgau et al. | 49/360 |

FOREIGN PATENT DOCUMENTS

| | | | |
|---|---|---|---|
| DE | 3732092 | A1 * | 4/1989 |
| DE | 29807556 | | 7/1999 |
| EP | 0 876 946 | | 11/1998 |
| GB | 2213524 | A * | 8/1989 |

* cited by examiner

*Primary Examiner*—Peter M Cuomo
*Assistant Examiner*—Eric Pico
(74) *Attorney, Agent, or Firm*—Fraser Clemens Martin & Miller LLC; William J. Clemens

(57) ABSTRACT

A door with a sliding door leaf has guides that are arranged in the region of an edge of the door leaf. The guides include a belt so aligned that it extends by the belt length thereof longitudinally of the guide surface for the door leaf in the direction of sliding of the door leaf. When the door leaf is sliding, the belt runs with the door leaf in such a manner that a portion of the belt bears against the guide surface when the door leaf is open, closed and sliding and thereby guides the door leaf.

16 Claims, 4 Drawing Sheets

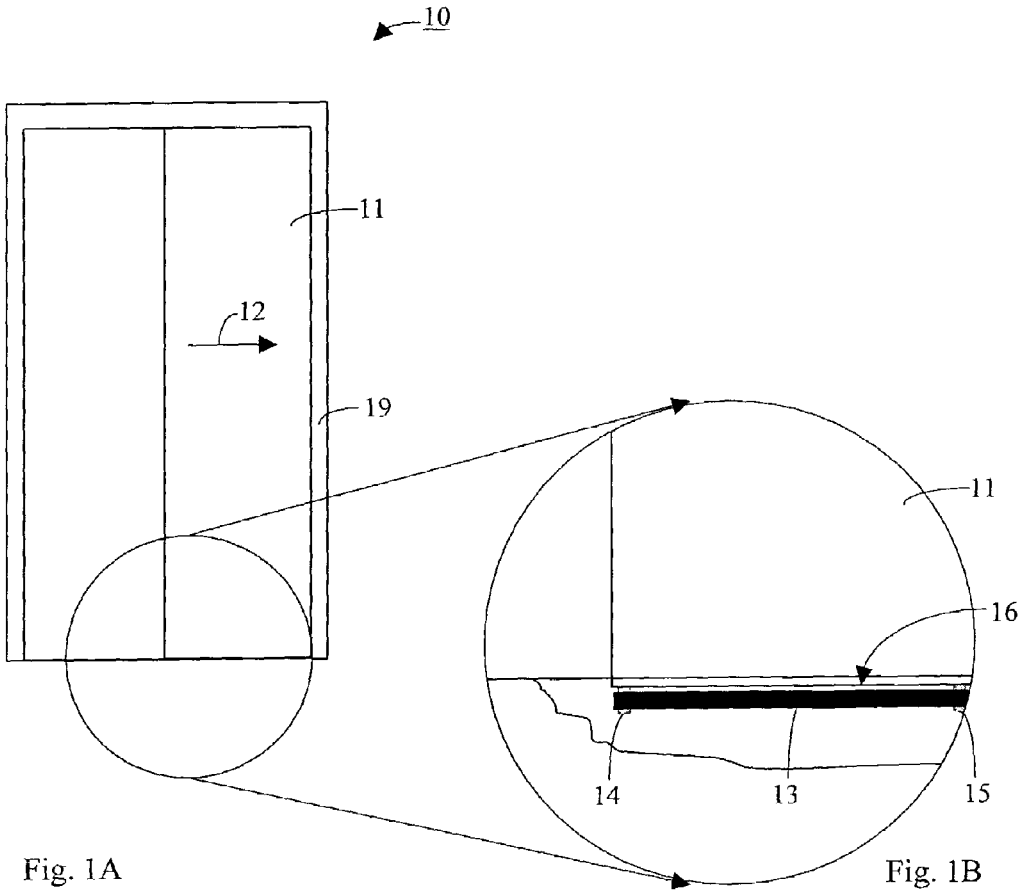
Fig. 1A
Fig. 1B
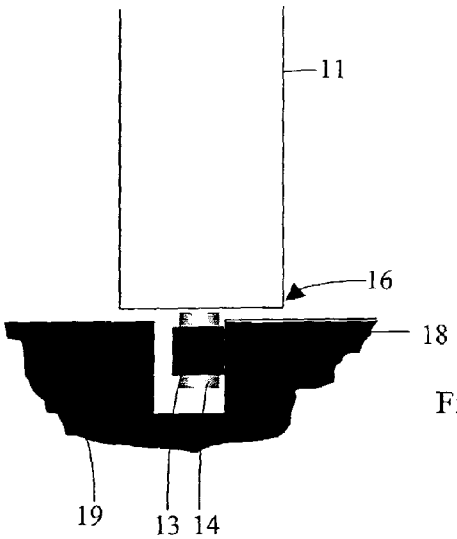
Fig. 1C

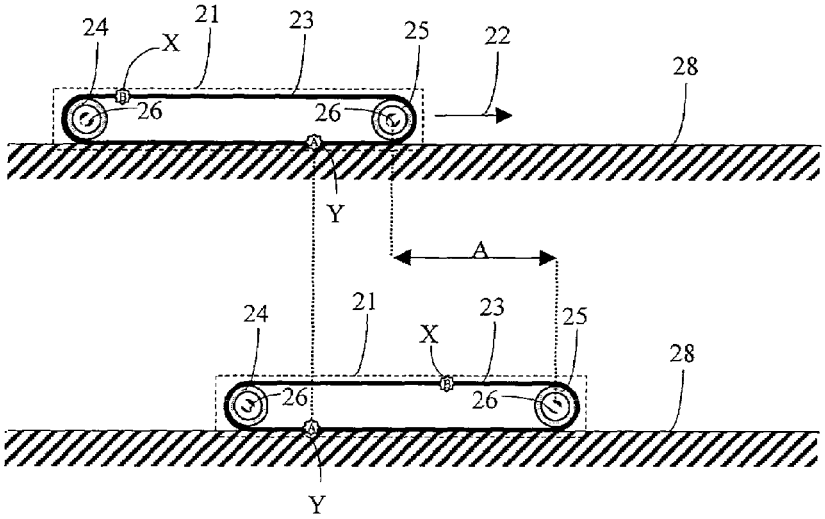
Fig. 2A
Fig. 2B
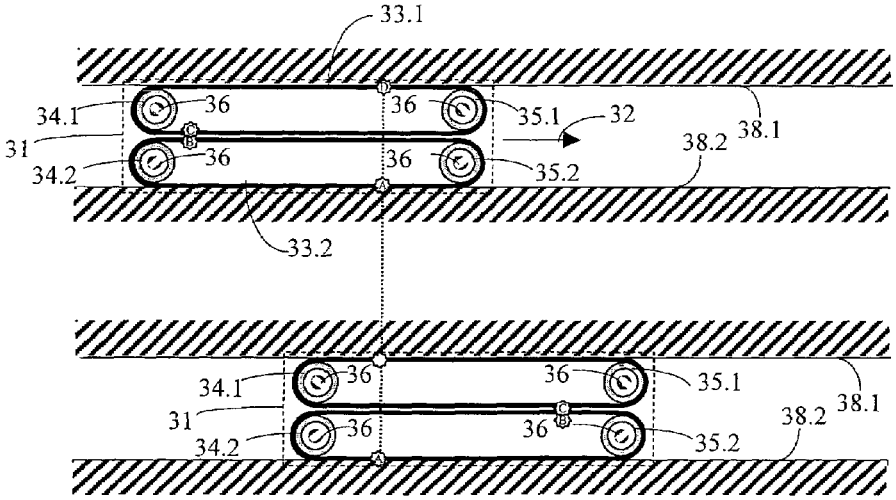
Fig. 3A
Fig. 3B

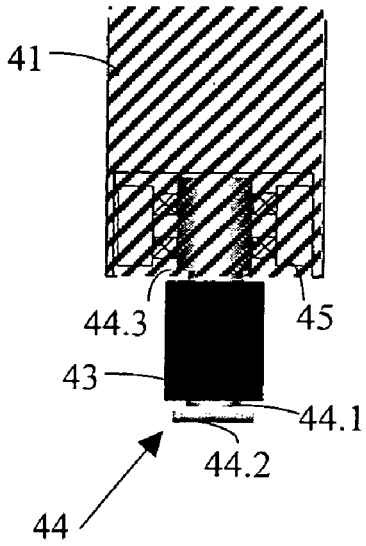
Fig. 4
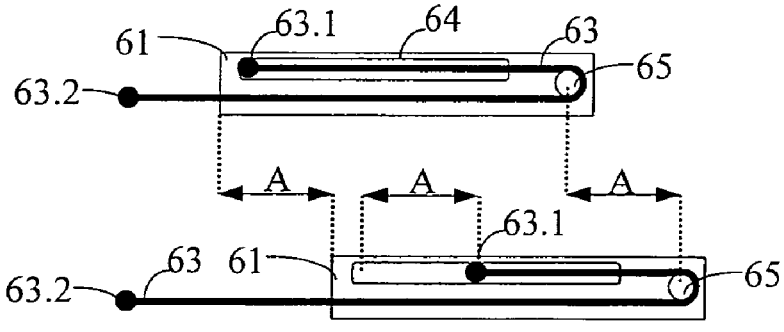
Fig. 5A
Fig. 5B

DOOR WITH SLIDING DOOR LEAF AND WITH GUIDE MEANS

BACKGROUND OF THE INVENTION

The present invention relates generally to a door with a sliding door leaf and an elevator installation with such a door.

Doors with sliding door leaves, which are also termed sliding doors, have numerous advantages; in particular, their need for space relative to the need for space of swinging doors is comparatively small, since the opening door leaves slide parallel to and in the immediate vicinity of the wall and thus do not demand any usable space in the region of the door opening.

The disadvantages of such doors with sliding door leaves reside particularly in that: the door leaves are not, or not sufficiently, guided and produce noises during their sliding, which can frequently be heard in remote areas of the building; the guide elements which serve for guidance of the door leaves during sliding thereof are subject to considerable wear; and the door leaves in closed state form only an unsealed or poorly sealed separation of the spaces connected by the door opening. This last-mentioned disadvantage is significant particularly in the case of shaft doors of elevator installations, since due to air currents, which are inevitable in an elevator shaft, a perceptible draft associated with a disturbing development of noise can be caused, for example, by the generally known "chimney effect" or by movements of an elevator car during travel through the shaft.

The mentioned disadvantages make themselves particularly noticeable in the case of a sliding door of the type shown in the U.S. Pat. No. 4,781,270 that is constructed for use in elevator installations and the door leaves of which are guided by means of slide elements, which elements are fastened to the door leaves, in guide grooves of a door threshold profile member. On sliding of such a door leaf the slide elements are exposed to a high level of sliding friction and accordingly are movable in a manner susceptible to wear and relatively noisily. Limits are imposed on optimization of the friction conditions by suitable material selection for the components of the door subject to friction, if only because of an inevitable contamination of the guide grooves in the door threshold profile member. Moreover, the slide elements have to be guided with a minimum amount of play in order to prevent jamming of the door leaf This is one cause of the mentioned sealing problems.

SUMMARY OF THE INVENTION

The present invention concerns a door that basically has two components, namely a sliding door leaf and a component which provides a guide surface for guidance of the door leaf during sliding, for example a component similar to a door frame or door case, which for the sake simplicity is termed frame in the following. The door leaf is displaceable back and forth relative to the frame in a direction of sliding. Moreover, guide means for guidance of the door leaf during its lateral sliding are provided. These guide means are disposed in the region of an edge of the door leaf, which moves along an adjacent part of the frame during sliding of the door leaf. The guide means substantially consist of a belt. The belt is so arranged that it runs in company with the sliding door leaf, whereby during sliding of the door leaf a portion of the belt bears against the guide surface. The belt is so aligned that it extends by the belt length thereof along the guide surface for the door leaf. A surface of the belt bears against the guide surface when the door leaf is open, sliding and closed.

It can be advantageous to provide one or more guide elements for the belt in order to align the belt at the guide surface. During sliding of the door leaf, the belt is so aligned by the guide elements that a portion of the belt bears against the guide surface and the belt runs over at least one of the guide elements. The guide means in that case guide the door leaf along the guide surface and impart stability to the leaf.

In addition, the guide means can be realized in such a manner that it serves as sealing means. This is of advantage particularly in the case of shaft doors of an elevator, since a reduced pressure or excess pressure frequently prevails in the elevator shaft, which has the consequence that air flows through the shaft doors. Apart from the fact that air currents of that kind can feel unpleasant, disturbing noises also thereby result. In the case of elevator installations with rapidly moving elevators the pressure differences are in part so large that the door leaves of a shaft door can be opened only with a high degree of force. Situations of that kind can be avoided by the guide elements according to the present invention.

For the case of a fire in a building it is also important in certain circumstances that the elevator shafts do not lead to a chimney effect which further fan a fire by a strong air current. In addition, in the case of insufficient sealing of an elevator shaft smoke can propagate over several floors.

A belt with resilient properties is preferably used for the doors according to the present invention. By the term belt with resilient properties there are to be understood, in the context of the invention, belts which are resilient in belt longitudinal direction and/or belt transverse direction and/or transversely to the belt surface. In particular, belts which are resilient in belt longitudinal direction do not need to be made or do not need to be completely made of resilient materials; they can also have one or more portions of virtually non-resilient material which are connected by portions of resilient material or which are interconnected by means of virtually non-resilient elements to be variable in length. Belts with use of which during sliding of the door leaf there is intended not only guidance of the door leaf and reduction of noise, but also sealing when the door is closed, are generally resiliently compressible in direction transversely to the belt surface, in respect of which it is to be understood that they are made of resiliently compressible material; however, they can also be made of resilient, but virtually incompressible material if they have a shape, for example with two connected limbs, which can be resiliently brought towards one another in a direction transverse to the belt surface. The belts that are used must in every instance have a flexibility that allows them to run around the guide elements.

In a first variant of the new door, the guide elements of the guide means are connected with the door leaf, whilst the guide surface is fixedly arranged at the frame or in the region of the frame, for example in a door threshold in the lower part of the door, in order to provide a lower door guide.

In a second variant of the new door, the guide elements of the guide means are arranged at the frame or in the region of the frame, whilst the guide surface is disposed at the door leaf in the region of the edge thereof.

With both variants the guide elements comprise one or more, preferably two, deflecting elements which are fastened at that component of the door which does not have the guide surface. The belt can be constructed as an endless belt or as an open belt with two belt ends. Endless belts can be anchored by at least one belt position at an anchorage point of the door component which has the guide surface; open belts can be anchored by at least one respective belt position in the region of the belt ends thereof at an anchorage point disposed in the region of the guide surface.

In a third variant, an open belt with two belt ends is used. A first belt end is anchored at a belt position to be stationary at an anchorage point disposed in the region of the guide surface; the second belt end is guided at a first guide element which forms a longitudinal guide. The belt runs between the fastened belt position and the longitudinal guide around the second guide element, which is formed by a deflecting body.

In general the door leaf is laterally displaceable and is suspended at its upper region; that edge of the door leaf in the region of which the guide means is disposed is then the lower edge of the door leaf.

However, the door leaf can also be displaceable in vertical direction; in that case, guide means in the sense of the invention can then be provided in the region of one or both lateral edges of the door leaf. The door leaf can form the sole door leaf or part of a door system with several door leaves slidable in the manner of wings.

The belt surface and the guide surface at which the belt surface bears can be constructed so that either a small degree of slip therebetween is possible or so that any slip is prevented. A relative slippage can be prevented in that the mutually contacting surfaces have a suitable profile with profile surfaces transverse to the direction of sliding (mechanically positive connection), or in that the belt surface bears with a sufficiently high degree of pressure against the guide surface, or in that materials are selected which ensure a sufficient degree of adhesion.

In order to prevent the belt from removing from the guide elements these can be provided with suitable means, for example end plates, or the guide elements of the belt can be profiled in suitable manner.

It has proved particularly advantageous to arrange the guide elements at the door leaf and construct them so that they have a smaller dimension transversely to the door leaf than the door leaf itself.

It is also advantageous to arrange at least one of the guide elements to be resiliently displaceable transversely to the door leaf and transversely to the direction of sliding of the door leaf. In the case of such an arrangement it is possible to keep the belt in contact with the guide surface by a bias which is controllable by the setting of the resiliently displaceable guide element.

At least one of the guide elements can be formed by at least one rotatable roller that is connected with the door leaf by way of slide bearings or roller bearings.

A guide element can also comprise several rollers and there can be provided a load compensating element in the form of a secondary belt which runs around these rollers and is arranged between the belt and the guide element.

The belt can, particularly when the door leaf is disposed in closed position, be able to be biased in the direction of the guide surface in order to form a sealing body between the guide surface and the surface of the door leaf.

The door can have, apart from the stated guide surface and the stated guide means, a further guide surface and further guide means which are so arranged that the door is guided in both directions transversely to the door leaf. In this manner there can be realized a guidance of the door leaf which is free of play transversely to the direction of movement. A door with a door leaf which is guided with no or only little play can be sealed particularly effectively, since zones, which are permeable to air, in the region of the guide can be substantially reduced or entirely avoided.

It is thus the object of the present invention to propose an improved door that does not have the above-mentioned disadvantages of conventional sliding doors.

According to the present invention there is also provided an elevator installation with a correspondingly guided door.

DESCRIPTION OF THE DRAWINGS

The above, as well as other advantages of the present invention, will become readily apparent to those skilled in the art from the following detailed description of a preferred embodiment when considered in the light of the accompanying drawings in which:

FIG. 1A is a front elevation view of a door according to the present invention;

FIG. 1B is an enlarged view of a portion of the door shown in FIG. 1A;

FIG. 1C is a cross sectional view of the portion of the door which is shown in FIG. 1B;

FIG. 2A is a schematic plan view a door leaf with guide means for a door according to the present invention, wherein the door leaf adopts a first position;

FIG. 2B is a view similar to FIG. 2A wherein the door leaf adopts a second position;

FIG. 3A is a schematic plan view of a door leaf with guide means for a door according to a second embodiment of the present invention having further guide means which similarly comprise guide elements and a belt, wherein the door leaf adopts a first position;

FIG. 3B is a view similar to FIG. 3A wherein the door leaf adopts a second position;

FIG. 4 is a cross sectional view of a door leaf with guide means according to a third embodiment of the present invention;

FIG. 5A is a schematic plan view of a door leaf with guide means for a door according to a fourth embodiment of the present invention wherein the door leaf adopts a first position;

FIG. 5B is a view similar to FIG. 5A wherein the door leaf adopts a second position.

DESCRIPTION OF THE PREFERRED EMBODIMENT

Figure 6:
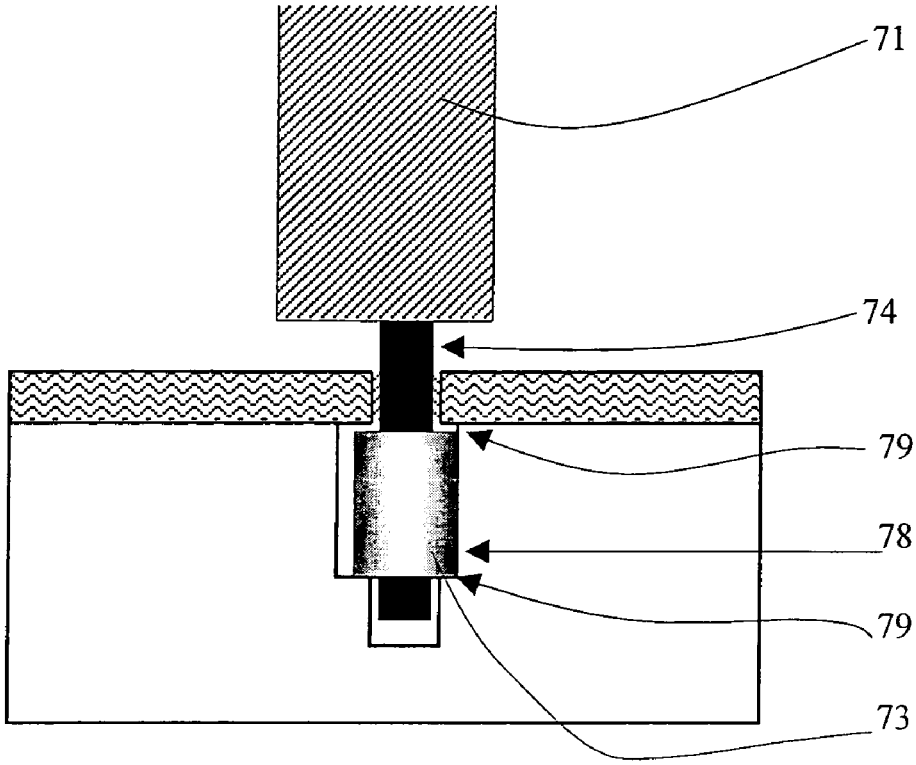
FIG. 6 is a cross sectional view of a door leaf with guide means according to a fifth embodiment of the present invention.

A first embodiment of the present invention is described in conjunction with FIGS. 1A to 1C. A door 10, which forms a shaft door of an elevator (not shown), is shown. The door 10 comprises at least one frame 19 and a door leaf 11 that is slidable in a direction 12 of sliding relative to the frame 19. Arranged at the frame 19 is a vertical guide surface 18 (see FIG. 1C) at which the door leaf 11 is to be guided. The door 10 comprises guide means that are arranged in the region of a lower edge 16 of the door leaf 11. The guide means comprise a (resilient) belt 13 and guide elements 14 and 15, which are arranged at the door leaf 11 and around which the belt 13 runs.

The belt 13 is so aligned by the guide elements 14, 15 that it extends by its belt length parallel to the direction 12 of sliding of the door leaf 11. A surface of the belt 13 bears flatly against the guide surface 18 when the door 11 is open, closed and sliding. In addition, the door leaf 11 can have a suspension (not shown) in the upper door region.

A schematic section of this form of embodiment is shown in FIG. 1C. A groove, which in the illustrated example of embodiment has a rectangular cross-section, is provided below the region of the door leaf core, or door leaf center surface, in the frame 19 or in the region of the frame. A vertical side surface of this groove forms the guide surface 18. The guide elements 14, 15, of which the guide element 14 is visible in FIG. 1C, are fastened in the lower region of the door leaf 11. Moreover, the resilient belt 13 and the part of this belt 13 running around the guide element 14 is to be seen in FIG. 1C. The respective part of the outer surface of the belt 13 facing the guide surface 18 bears against the guide surface 18, whilst the respective part of the outer surface of the belt 13 remote from the guide surface 18 extends freely and substantially without contact. The inner surface of the belt 13 is intended for contact with the guide elements 14, 15.

The manner of effect of the arrangement according to the present invention is based, according to FIG. 2A and FIG. 2B, on the principle of a vehicle chain which is used in connection with continuous movement, for example of a track-laying vehicle. A belt 23 moves to a certain extent like the vehicle chain. If a door leaf 21 of a door slides out of a first position according to FIG. 2A over a path A into a second position according to 2B, guide elements 24, 25 move rigidly with the door leaf 21. The respective part of the belt 23 bearing against a guide surface 28 remains substantially stationary during sliding of the door leaf 21. On sliding of the door leaf 21 in the direction of an arrow 22, parts of the belt 23 previously free of contact progressively come into contact with the guide element 25, whilst parts of the belt 23 originally contacting the guide surface 28 come into contact with the guide element 24 and are then free of contact. Fastening means (for example, axles or screws) for the guide elements are denoted by 26. It may also be mentioned that belt positions denoted by X and Y serve only for clarification of the manner of effect and are not positions at which the belt 23 is fastened.

On sliding of the door leaf 21, the belt 23 runs and/or glides around the guide elements 24 and 25. Due to the fact that on opening or closing of the door leaf 21 there is no or only a slight sliding movement of the belt 23 along the surface 28, hardly any noises arise. Since the belt 23 does not slide or hardly slides on the surface 28 and consequently only low friction losses arise, the expenditure of energy and the wear of the belt 23, the guide bodies 24, 25 and the guide surface 28 are very small.

In this form of arrangement, the guide means guide the door leaf 21; they impart stability to the door leaf 21 and they avoid or prevent movement of the door leaf 21 transversely to the door leaf surface and transversely to the movement direction in the case of horizontal sliding thereof. However, this guidance is only at one side. A guidance at both sides can be achieved with an arrangement according to FIG. 3A and FIG. 3B. In this arrangement the door has a door leaf 31 slidable in the direction of an arrow 32. Moreover, first guide means and second guide means are provided. The first guide means comprises a belt 33.1 as well as guide elements 34.1, 35.1. The second guide means comprises a further belt 33.2 as well as guide elements 34.2, 35.2. Fastening means for the guide elements are denoted by 36. A guide surface 38.1 as well as a further guide surface 38.2 are provided, wherein the guide surface 38.2 is disposed opposite the guide surface 38.1. The belt 33.1, the guide elements 34.1, 35.1 and the guide surface 38.1 co-operate in the same manner as described further above with respect to FIGS. 2A and 2B for the belt 23, the guide elements 24, 25 and the guide surface 28. The further belt 33.2, the further guide elements 34.2, 35.2 and the further guide surface 38.2 co-operate similarly in the same manner as described further above with respect to FIGS. 2A and 2B for the belt 23, the guide elements 24, 25 and the guide surface 28; the further belt 33.2, however, during movement of the door leaf 31 has a respective sense of circulation which is opposite to the sense of circulation of the belt 33.2. Since the door leaf is guided at both sides, this guidance can be formed without play transversely to the movement direction. Since the belts 33.1 and 33.2 bear flatly on the respective guide surfaces 38.1 and 38.2, an effective door seal is present in the region of the guide surfaces. In the case of guidance at one side, for example, according to the forms of embodiment illustrated in FIGS. 1C, 2A and 2C, an effective door seal can also be achieved if the door is so moved that the respective belt bears flatly against the respective guide surface. In any of these cases air-permeable zones in the region of the guide surfaces are entirely or at least largely avoidable.

Of course, in either of the embodiments discussed above, the guide surfaces (28, 38.1, 38.2) can be formed in the door leaves (21, 31) and the guide elements (24, 25, 34.1, 34.2, 35.1, 35.2) can be attached to the door frame or door case.

FIG. 4 shows a detail of a door according to a third embodiment of the present invention. A door leaf 41 has a groove going out from its lower edge. Fastened in the region of this groove by way of roller bearings 45 is a guide element 44 in the form of a deflecting roller, which is rotatable about a vertical axis (not illustrated). The guide element 44 substantially consists of a belt guide portion 44.1, a lower end plate 44.2 and an upper portion 44.3 in the region of the roller bearings 45. A belt 43, the belt width of which extends in vertical direction, runs around the belt guide portion 44.1 of the guide element 44. The belt guide portion 44.1 forms, between the larger diameter end plate 44.2 and the larger diameter upper portion 44.3, a groove-like depression at the surface of the guide element 44. This depression forms a guide structure for the belt, which ensures lateral guidance of the belt 43 during running of the belt 43 around the guide element 44.

FIGS. 5A and 5B show a fourth embodiment of the door according to the present invention, with a door leaf 61. FIG. 5A shows the door leaf 61 in a first position, and FIG. 5B in a second position in which the door leaf 61 is displaced opposite to the first position over a path A. The guide means comprise an open belt 63 and two guide elements 64, 65 at the door leaf 61. The first guide element 64 is a longitudinal guide for a first belt end 63.1, which extends in the sliding direction of the door leaf 61. The second guide element 65 is a deflecting element or a deflecting roller. The belt 63 is fastened by its second belt end 63.2 at or in the region of the frame (not illustrated).

Spring elements (not shown) can be used which ensure a pressing pressure of the belt in the direction of the guide surface and/or produce a bias of the belt.

Other forms of guide elements can be used instead of deflecting rollers that rotate about an axis. Particularly suitable, for example, are "Nylon" guide elements or "Teflon"-coated guide elements that are fixed to enable sliding of the belt thereon.

According to the present invention the individual aspects of the various forms of embodiment can be combined with one another. In addition, the belt can be guided and deflected in the most diverse way.

As alternative to the possibility illustrated in FIG. 4 of laterally guiding the belt during sliding of the door leaf, there is the variant of constructing a guide structure for lateral guidance of the belt at the guide surface itself. This fifth embodiment is illustrated in FIG. 6. A door leaf 71 slidable along a guide surface 78 is illustrated in FIG. 6 in a cross-section perpendicular to the direction of sliding of the door leaf. Fastened to the door leaf is a guide element 74, around which a belt 73, which comprises a belt portion bearing flatly against the guide surface 78, is moved during sliding of the door leaf. The guide structure for the belt 73 is constructed in the form of a groove 79 which narrows above and below the guide surface 78 to limit the lateral movement play space of the belt 73 perpendicularly to the movement direction of the door leaf 71 on the guide surface 78.

In a further development of this variant a lateral guide structure, which acts at one side or at both sides, for one of the disclosed belts can also be created in the manner that a guide element for the belt and/or the associated guide surface is or are suitably structured on one or both sides of the belt in order to restrict the movement play area of the belt transversely to the direction of the movement of the door leaf.

Different possibilities of optimization exist within the frame of the present invention with respect to the selection of material for the belt and the preparation of the respective surfaces of the belt to be brought into contact with one of the guide surfaces or with one of the guide elements. In the case of a guide element, which is rigidly fastened to a door leaf, for the belt the side of the belt facing the guide element is to slide over the guide element so that the belt is movable, in accordance with the present invention, around the guide element when the door leaf is slid along the guide surface. In this case it is advantageous to construct the belt (13, 23, 33, 43, 63, 73) as a laminated structure of several layers with different material composition. For example, a layer to be brought into contact with the guide element can be made of a material that ensures a low sliding friction between belt and guide element. The material for another layer can be selected so that the belt has a high tear strength, particularly in the case of loads in the direction of sliding of the door leaf. A layer to be brought into contact with the guide surface could be made of a material which is insensitive relative to contaminants and/or insensitive to wear or could be so optimized that an optimum sealing at the guide surface is achieved. A laminated structure with laminae, which are oriented along the direction of sliding of the door leaf, for example, ensures good sealing, particularly when the laminated structure is formed from a resilient material and thus the precondition is created that the laminae form a gapless contact with the guide surface under the action of a light pressing pressure.

In the case of the guide element 44, which is rotatable about an axis perpendicular to the direction of movement of the door leaf, or generally guide elements which in the case of sliding of the door leaf are movable together with the belt portion bearing against the guide element, it can thereagainst be of advantage if the side of the belt bearing against the guide element consists of a material which ensures a high degree of friction with respect to the surface of the guide element. Transport of the belt around the guide element can then be satisfactorily controlled in the case of sliding of the door leaf.

The present invention offers the possibility of optimally matching the property of the boundary surface between guide element and the belt bearing thereagainst to one another independently of the property of the guide surface. The invention is also usable on straight or curved door leaves which are guided along a curved guide surface.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A sliding door comprising:

a door leaf having a front surface and an edge surface extending perpendicular to the front surface;

a guide surface for guiding the door leaf the guide surface being generally parallel to the front surface of the door leaf;

at least one guide element having an axis of rotation extending generally perpendicular to the edge surface; and a movable belt engaging the at least one guide element and having a portion which contacts the guide surface during sliding of the door leaf.

2. The door according to claim 1 wherein the guide surface is disposed in a region of a door frame or a door case for the door leaf and the at least one guide element is attached to the edge surface of the door leaf.

3. The door according to claim 2 wherein the at least one guide element is a roller rotatably attached to the door leaf.

4. The door according to claim 1 wherein the guide surface is disposed in the door leaf and the at least one guide element is attached to a region of a door frame or a door case for the door leaf.

5. The door according to claim 1 wherein the guide surface is a pair of facing guide surfaces and including at least another guide element mounted to extend generally parallel to the plane of the door leaf and another movable belt engaging said at least another guide element and having a portion contacting one of the facing guide surfaces during sliding of said door leaf relative to the facing guide surfaces.

6. The door according to claim 1 wherein the at least one guide element holds the movable belt against the guide surface.

7. The door according to claim 1 wherein the movable belt seals against the guide surface to prevent air leakage between opposite sides of the door leaf.

8. The door according to claim 1 including means for restricting movement of said movable belt laterally relative to the guide surface.

9. The door according to claim 1 wherein the movable belt has resilient properties.

10. The door according to claim 1 wherein the movable belt has a laminated structure.

11. A door used in an elevator installation comprising:

at least one elevator door leaf having a front surface and an edge surface extending perpendicular to said front surface;

at least one guide element mounted on said edge surface and having an axis of rotation extending generally perpendicular to a plane of said edge surface; and a movable belt engaging said at least one guide element, said movable belt having a portion adapted for contact with a guide surface during sliding of said at least one elevator door leaf relative to the guide surface, said guide surface extending in a plane generally perpendicular to the plane of said edge surface.

12. The door according to claim 11 including another guide element mounted on said edge surface and having an axis of rotation extending generally perpendicular to the plane of said edge surface and said movable belt being an endless belt engaging said another guide element.

13. The door according to claim 11 wherein said movable belt has a first end fixed to said at least one elevator door leaf and a second end fixed relative to the guide surface.

14. The door according to claim 11 wherein at least one said guide element includes a belt guide portion engaging said movable belt and having a first diameter, a lower end plate attached at a lower end of said belt guide portion and having a second diameter larger than said first diameter, and an upper portion attached at an upper end of said belt guide portion and having a third diameter larger than said first diameter.

15. The door according to claim 14 including a roller bearing mounted in said at least one elevator door leaf and rotatably retaining said upper portion of said at least one guide element.

16. The door according to claim 11 wherein said at least one guide element is adapted to extend into narrowed portions of a groove above and below the guide surface for restricting movement of said belt laterally relative to the guide surface.

* * * * *

UNITED STATES PATENT AND TRADEMARK OFFICE

CERTIFICATE OF CORRECTION

PATENT NO. : 7,506,727 B2
APPLICATION NO. : 10/677989
DATED : March 24, 2009
INVENTOR(S) : Peter Spiess It is certified that error appears in the above-identified patent and that said Letters Patent is hereby corrected as shown below:

Cover Page, Foreign Application Priority Data should read as follows:
Oct. 4, 2002 (EP) ..... 02022422.6

Signed and Sealed this

Nineteenth Day of May, 2009

John Doll

JOHN DOLL
*Acting Director of the United States Patent and Trademark Office*